US010850749B2

(12) United States Patent
Tamura et al.

(10) Patent No.: US 10,850,749 B2
(45) Date of Patent: Dec. 1, 2020

(54) RAILCAR BOGIE

(71) Applicant: KAWASAKI JUKOGYO KABUSHIKI KAISHA, Kobe (JP)

(72) Inventors: Yoshihiro Tamura, Kobe (JP); Yukitaka Taga, Kobe (JP); Fumikazu Kounoike, Kakogawa (JP); Takaya Ono, Kobe (JP)

(73) Assignee: KAWASAKI JUKOGYO KABUSHIKI KAISHA, Kobe (JP)

( * ) Notice: Subject to any disclaimer, the term of this patent is extended or adjusted under 35 U.S.C. 154(b) by 0 days.

(21) Appl. No.: 16/482,186

(22) PCT Filed: Jan. 16, 2018

(86) PCT No.: PCT/JP2018/000914
§ 371 (c)(1),
(2) Date: Jul. 30, 2019

(87) PCT Pub. No.: WO2018/139247
PCT Pub. Date: Aug. 2, 2018

(65) Prior Publication Data

US 2019/0375436 A1 Dec. 12, 2019

(30) Foreign Application Priority Data

Jan. 30, 2017 (JP) ..... 2017-013774

(51) Int. Cl.
*B61F 5/30* (2006.01)
*B61F 5/52* (2006.01)

(52) U.S. Cl.
CPC . *B61F 5/30* (2013.01); *B61F 5/52* (2013.01)

(58) Field of Classification Search
CPC .... B61F 5/302; B61F 5/32; B61F 5/46; B61F 5/52; B61F 3/02; B61F 5/305; B61F 5/325; B61F 5/36; B61F 5/50
USPC ..... 105/206.2, 206.1, 218.2
See application file for complete search history.

(56) References Cited

U.S. PATENT DOCUMENTS

2015/0344046 A1* 12/2015 Nishimura ..... B61F 5/302 105/199.1
2016/0304102 A1 10/2016 Okumura et al.
2018/0029617 A1 2/2018 Okumura

FOREIGN PATENT DOCUMENTS

CN 102717810 A 10/2012
CN 104884329 A 9/2015
CN 105313913 A 2/2016
GB 2134469 A 8/1984
(Continued)

*Primary Examiner* — Mark T Le
(74) *Attorney, Agent, or Firm* — Oliff PLC

(57) ABSTRACT

An axle box suspension includes: a coupler extending from an axle box in a car longitudinal direction and including a tubular portion at an end portion of the coupler, the tubular portion being open toward both sides in a car width direction; a core rod inserted into an internal space of the tubular portion, a pair of protruding portions being provided at both sides of the core rod in the car width direction; an elastic body interposed between the tubular portion and the core rod; a pair of receiving seats provided at the bogie frame and including a pair of groove portions which are open toward the car width direction and an upper side; a pair of lids pressing, from above, the pair of protruding portions fitted into the pair of groove portions from above; and fasteners fixing the lids to the receiving seats.

11 Claims, 6 Drawing Sheets

(56) References Cited

FOREIGN PATENT DOCUMENTS

| | | | | |
|---|---|---|---|---|
| JP | S48-21765 | Y | | 6/1973 |
| JP | 2014-133483 | A | | 7/2014 |
| JP | 2015-107773 | A | | 6/2015 |
| WO | WO 2013/150720 | | * | 10/2013 |
| WO | 2016/125447 | A1 | | 8/2016 |

* cited by examiner

RAILCAR BOGIE

TECHNICAL FIELD

The present invention relates to a railcar bogie including an axle box suspension.

BACKGROUND ART

In a railcar bogie, an axle box is supported by an axle box suspension so as to be displaceable relative to a bogie frame. There are various types of axle box suspensions. For example, in an axle beam type axle box suspension disclosed in PTL 1, an axle spring constituted by a coil spring is interposed between an axle box and a bogie frame, and a tip end portion of an axle beam extending from the axle box in a car longitudinal direction is supported by receiving seats of the bogie frame. A tubular portion is formed at the tip end portion of the axle beam, and a core rod is inserted into the tubular portion through rubber. A pair of protruding portions projecting from the core rod toward both sides in a car width direction are fitted into fitting grooves of the receiving seats of the bogie frame from below and are supported from below by lids configured to close the fitting grooves.

CITATION LIST

Patent Literature

PTL 1: Japanese Laid-Open Patent Application Publication No. 2015-107773

SUMMARY OF INVENTION

Technical Problem

When assembling the bogie, with the protruding portions of the core rod fitted into the fitting grooves of the receiving seats, the lids need to be fastened to the receiving seats from below by fasteners. Therefore, an operator needs to get under the bogie and perform the fastening work while supporting the lid, which is low in a work property. Load generated when the core rod is about to come out downward from the fitting grooves is supported by the lids from below. In consideration of this, fastening strength of the fasteners needs to be designed. Further, by providing loosening preventing parts or falling preventing parts at the lids, the bogie frame and the axle box need to be prevented from separating from each other.

An object of the present invention is to improve an assembly work property of a bogie.

Solution to Problem

A railcar bogie according to one aspect of the present invention includes: a bogie frame; a plurality of axle boxes accommodating a plurality of bearings supporting a plurality of axles; and a plurality of axle box suspensions coupling the plurality of axle boxes to the bogie frame. Each of the plurality of axle box suspensions includes: a coupler extending from the corresponding axle box in a car longitudinal direction and including a tubular portion at an end portion of the coupler, the tubular portion being open toward both sides in a car width direction; a core rod inserted into an internal space of the tubular portion, a pair of protruding portions being provided at both sides of the core rod in the car width direction; an elastic body interposed between the tubular portion and the core rod; a pair of receiving seats provided at the bogie frame and including a pair of groove portions which are open toward the car width direction and an upper side; a pair of lids pressing, from above, the pair of protruding portions fitted into the pair of groove portions from above; and fasteners fixing the lids to the receiving seats.

According to the above configuration, the groove portions into which the protruding portions of the core rod are fitted are open upward. Therefore, when assembling the bogie, the protruding portions of the core rod are fitted into the groove portions from above, and the lids cover the protruding portions from above and are fixed to the receiving seats. Thus, assembling work of the axle box suspension can be performed from an upper side, and this improves the work property. Further, load generated when the core rod is about to come out from the fitting groove is not supported by the lids but is supported from below by the receiving seats provided at the bogie frame. Therefore, even if the fasteners fall off, the core rod and the coupler do not fall from the bogie frame. Further, since it is unnecessary to additionally provide a loosening preventing part, a falling preventing part, or the like, the number of parts can be reduced.

Advantageous Effects of Invention

According to the present invention, the assembly work property of the railcar bogie improves.

DESCRIPTION OF EMBODIMENTS

Hereinafter, an embodiment will be described with reference to the drawings. In the following description, a direction in which a railcar travels, i.e., a carbody extends is defined as a car longitudinal direction, and a lateral direction perpendicular to the car longitudinal direction is defined as a car width direction. The car longitudinal direction is also referred to as a front-rear direction, and the car width direction is also referred to as a left-right direction.

Figure 1:
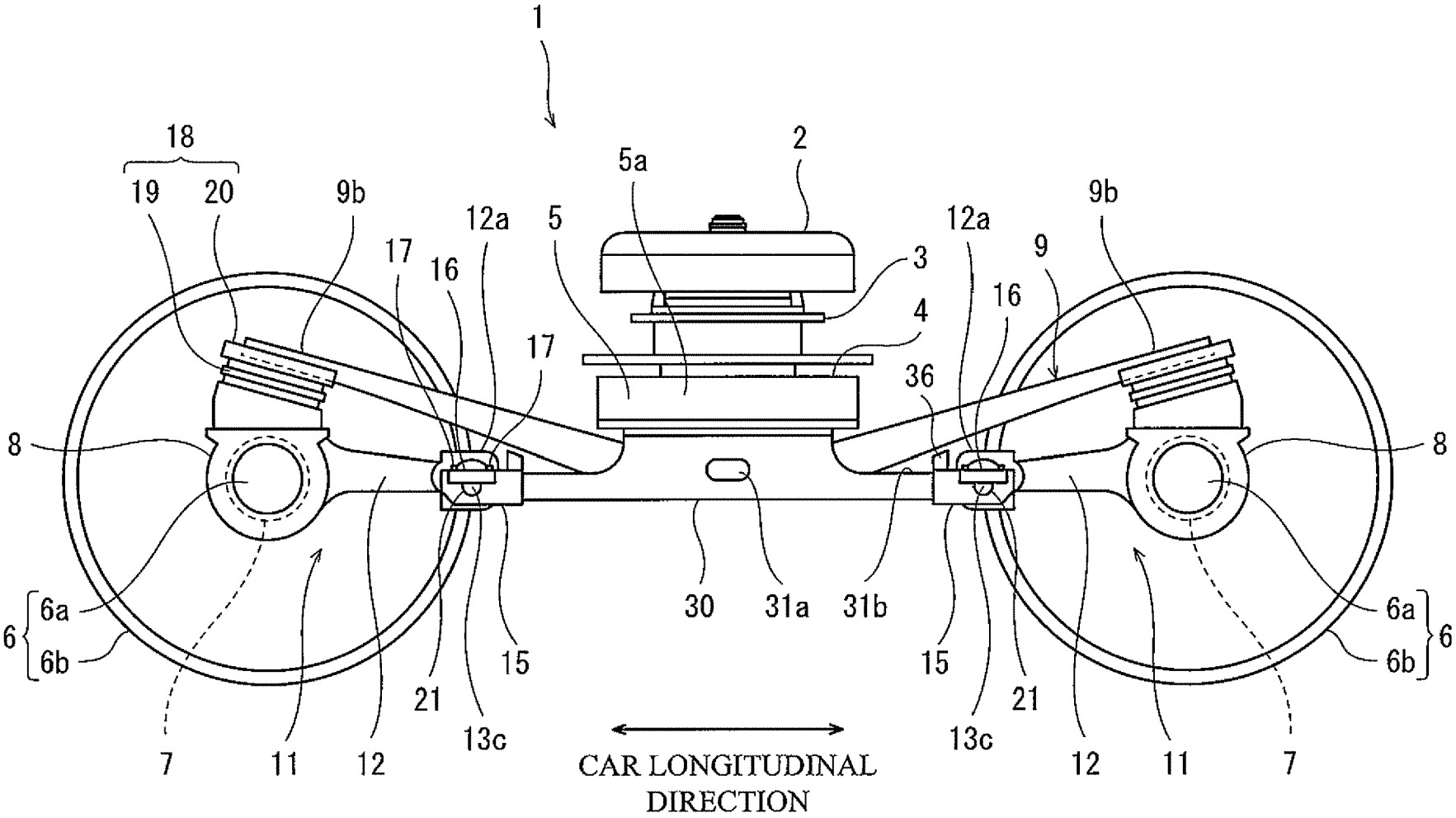
FIG. 1 is a side view of a railcar bogie according to an embodiment.
Figure 2:
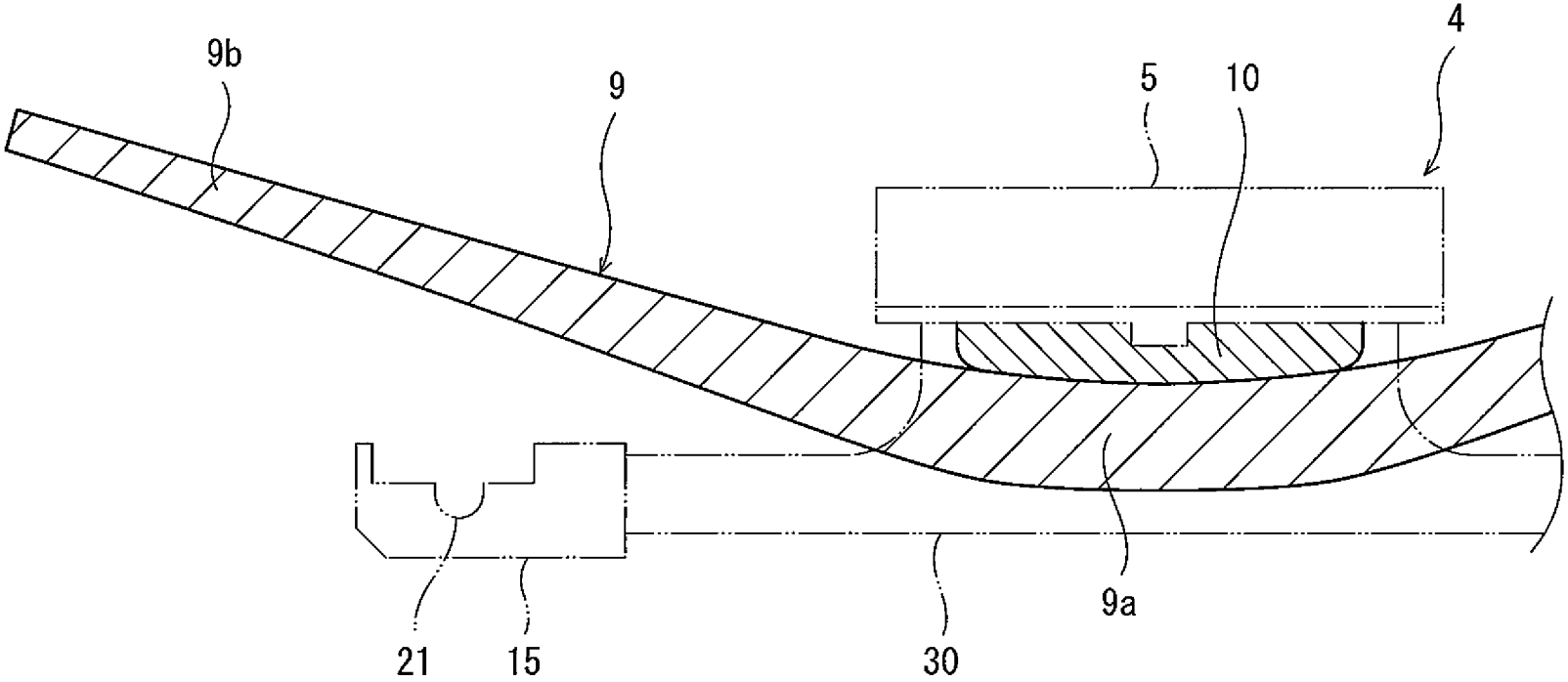
FIG. 2 is a sectional view showing a plate spring and pressing member of the bogie shown in FIG. 1 when viewed from a car width direction.
Figure 3:
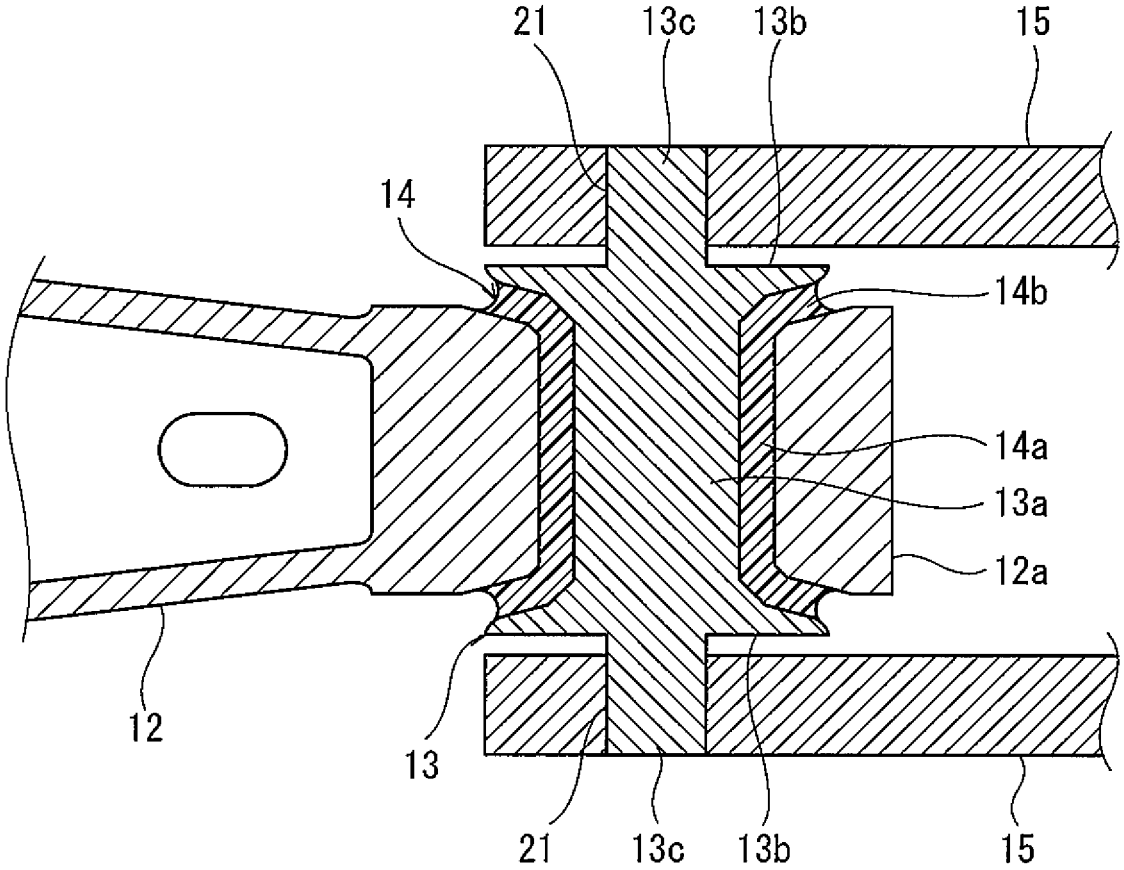
FIG. 3 is a sectional view showing a tubular portion of an axle beam and its vicinity shown in FIG. 1 when viewed from above.

FIG. 1 is a side view of a railcar bogie 1 according to the embodiment. FIG. 2 is a sectional view showing a plate spring and pressing member of the bogie 1 shown in FIG. 1 when viewed from the car width direction. FIG. 3 is a sectional view showing a tubular portion of an axle beam and its vicinity shown in FIG. 1 when viewed from above. As shown in FIG. 1, the railcar bogie 1 includes a bogie frame 4 supporting a carbody (not shown) through an air spring 2 (secondary suspension) and a bolster 3. The bogie frame 4 includes a cross beam 5 extending in the car width direction at a car longitudinal direction middle of the bogie 1 but does not include so-called side sills.

The cross beam 5 is connected to the bolster 3 so as to be turnable relative to the bolster 3. The bolster 3 is connected to the carbody through the air spring 2 and a bolster anchor (not shown). A pair of wheelsets 6 are arranged at both sides of the cross beam 5 in the car longitudinal direction. Each of the wheelsets 6 includes: an axle 6*a* extending in the car width direction; and wheels 6*b* provided at both respective sides of the axle 6*a* in the car width direction. Both car width direction side portions of the axle 6*a* are rotatably supported by respective bearings 7, and the bearings 7 are accommodated in respective axle boxes 8.

The axle boxes 8 support respective end portions 9*b* of plate springs 9 each extending in the car longitudinal direction. Longitudinal direction middle portions 9*a* of the plate springs 9 support respective car width direction end portions 5*a* of the cross beam 5. To be specific, each of the plate springs 9 is supported by a pair of axle boxes 8 arranged away from each other in the car longitudinal direction at each of both sides of the bogie 1 in the car width direction and supports the bogie frame 4. Therefore, the plate spring 9 has both the function of a primary suspension and the function of a conventional side sill. The plate spring 9 is made of, for example, fiber-reinforced resin. The plate spring 9 is formed in a bow shape that is convex downward as a whole in a side view of the bogie.

As shown in FIGS. 1 and 2, the bogie frame 4 includes a pressing member 10 provided at a lower portion of the end portion 5*a* of the cross beam 5. The middle portion 9*a* of the plate spring 9 is located right under the pressing member 10. The middle portion 9*a* of the plate spring 9 is located lower than the end portions 9*b*. An upper surface of the middle portion 9*a* has a circular-arc shape that is convex downward in a side view of the bogie. A lower surface of the pressing member 10 has a circular-arc shape that is convex downward in a side view of the bogie. The pressing member 10 is placed on the middle portion 9*a* of the plate spring 9 from above. The pressing member 10 presses an upper surface of the plate spring 9 by gravitational downward load from the cross beam 5 without being fixed to the plate spring 9 so as to be separable from the upper surface of the plate spring 9. To be specific, the pressing member 10 presses the upper surface of the plate spring without being connected to the plate spring 9 by a fixture (such as a bolt). In other words, the pressing of the pressing member 10 against the upper surface of the plate spring 9 is kept by the gravitational downward load from the cross beam 5 and reaction force of the plate spring 9. With this, the plate spring 9 can swing while changing a region pressed against the lower surface of the pressing member 10. It should be noted that the bogie frame 4 may be directly or indirectly placed on the upper surface of the middle portion 9*a* of the plate spring 9. A buffer sheet may be interposed between the pressing member 10 and the plate spring 9.

As shown in FIGS. 1 and 3, the axle box 8 is coupled to the bogie frame 4 by an axle box suspension 11. The axle box suspension 11 includes an axle beam 12 (coupler), a core rod 13, an elastic bushing 14, a pair of receiving seats 15, a pair of lids 16, and a plurality of fasteners 17. To be specific, the bogie 1 is a so-called axle beam type bogie. An upper surface of the axle box 8 is inclined toward a bogie middle side. A spring seat 18 is attached to an upper portion of the axle box 8, and the end portion 9*b* of the plate spring 9 extending in the car longitudinal direction is placed on the spring seat 18 from above so as to be separable from the spring seat 18 without being fixed to the spring seat 18. To be specific, both longitudinal direction end portions 9*b* of the plate spring 9 are supported by the respective axle boxes 8 through the spring seats 18. Each of the spring seats 18 includes an elastic body 19 (such as a multi-layer rubber) and a receiving member 20. The elastic body 19 is positioned on the upper surface of the axle box 8. The receiving member 20 is positioned on the elastic body 19, and the end portion 9*b* of the plate spring 9 is placed on the receiving member 20. It should be noted that the plate spring 9 and the receiving member 20 are not fixed to each other.

The axle beam 12 extends in the car longitudinal direction from the axle box 8 to the bogie middle side. A tubular portion 12*a* that is open toward both sides in the car width direction is provided at a tip end of the axle beam 12. The tubular portion 12*a* is formed by fixing a separate semi-tubular portion by bolts to a semi-tubular portion integrally formed at the tip end of the axle beam 12. The core rod 13 is inserted into an internal space of the tubular portion 12*a* in the car width direction. The core rod 13 includes a columnar portion 13*a*, a pair of conical flange portions 13*b*, and protruding portions 13*c*. The flange portions 13*b* are provided at both respective car width direction sides of the columnar portion 13*a*. The protruding portions 13*c* project outward in the car width direction from both respective side surfaces of the flange portions 13*b*.

The elastic bushing 14 (for example, a rubber bushing) includes a tubular elastic body (for example, rubber) and is interposed between the core rod 13 and the tubular portion 12*a*. The elastic bushing 14 includes a cylindrical portion 14*a* and a pair of flange portions 14*b* projecting outward in a radial direction from both respective car width direction sides of the cylindrical portion 14*a*. The elastic bushing 14 is externally fitted to the core rod 13. The protruding portions 13*c* of the core rod 13 project in the car width direction beyond the tubular portion 12*a* of the axle beam 12.

The pair of receiving seats 15 are provided at the bogie frame 4 and include a pair of groove portions 21 depressed downward. The pair of protruding portions 13*c* of the core rod 13 are fitted into the pair of groove portions 21 from above. Each of the lids 16 is fixed to the receiving seat 15 by fasteners 17 (for example, bolts) while pressing, from above, the protruding portion 13*c* accommodated in the groove portion 21. The bogie frame 4 includes receiving beams 30 extending from the respective end portions 5*a* of the cross beam 5 toward both sides in the car longitudinal direction, and the receiving seats 15 are provided at respective tip ends of the receiving beams 30.

Figure 4:
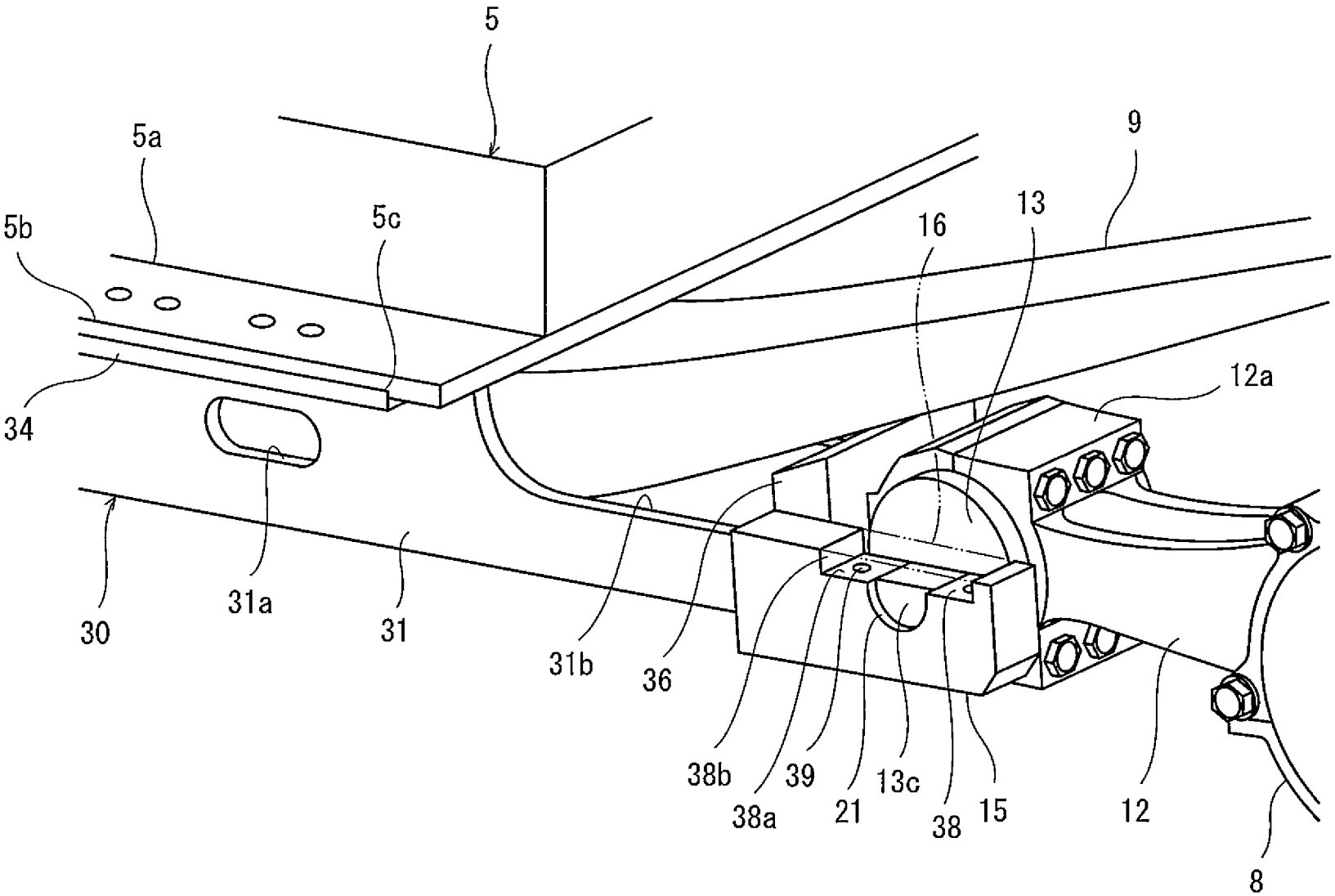
FIG. 4 is a perspective view showing a receiving beam, a receiving seat, and their vicinities shown in FIG. 1 when viewed from above.
Figure 5:
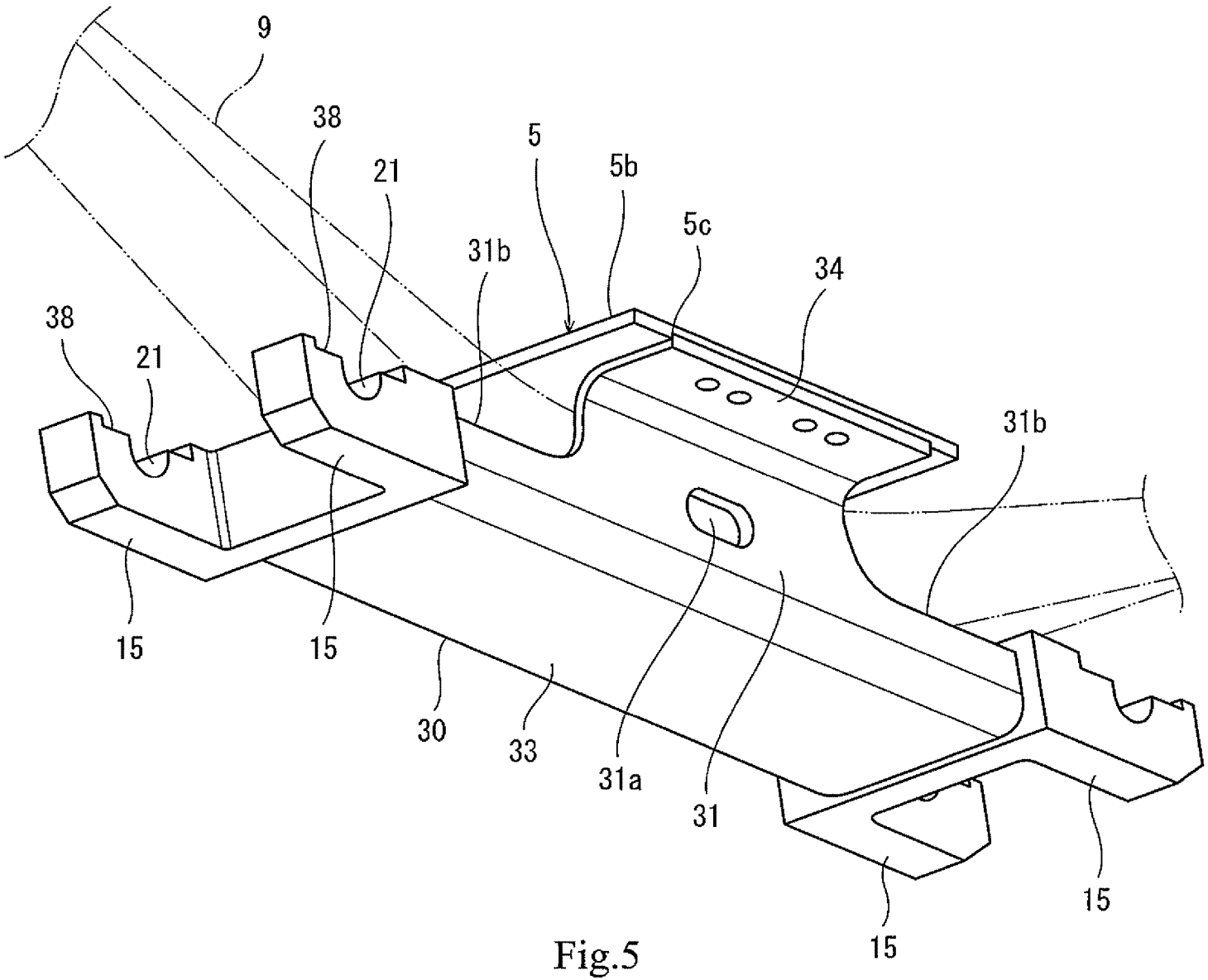
FIG. 5 is a perspective view showing the receiving beam, the receiving seat, and their vicinities shown in FIG. 4 when viewed from below.
Figure 6:
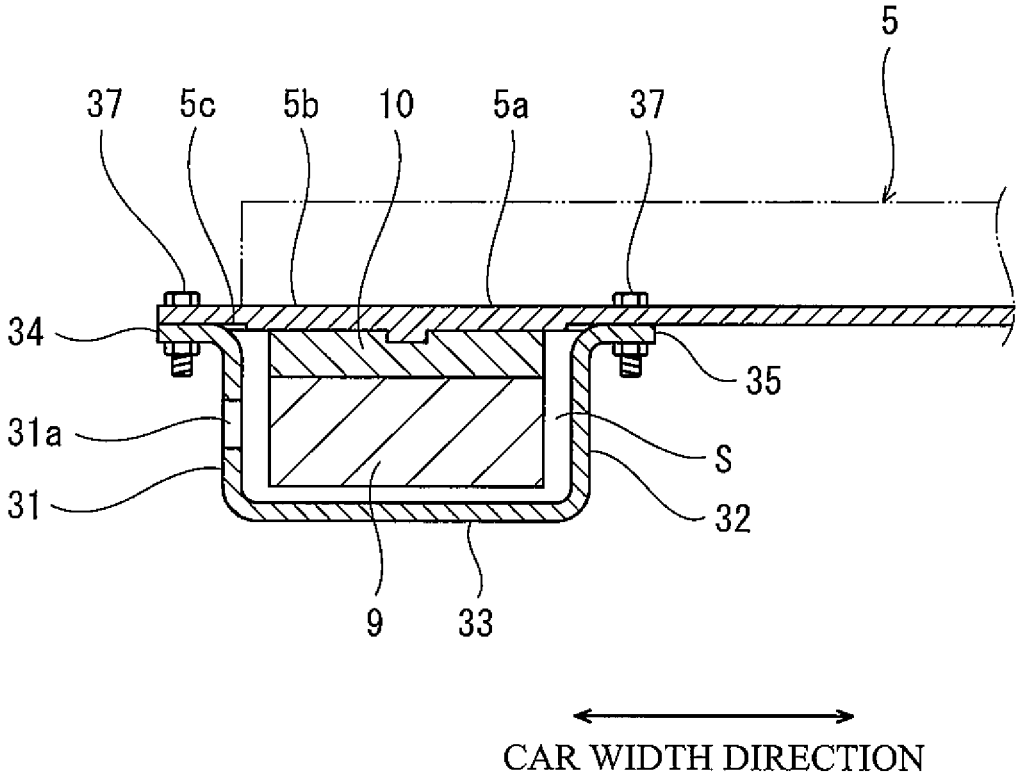
FIG. 6 is a sectional view showing a middle portion of the plate spring and its vicinity shown in FIG. 4 when viewed from a car longitudinal direction.

FIG. 4 is a perspective view showing the receiving beam 30, the receiving seat 15, and their vicinities shown in FIG. 1 when viewed from above. FIG. 5 is a perspective view showing the receiving beam 30, the receiving seat 15, and their vicinities shown in FIG. 4 when viewed from below. FIG. 6 is a sectional view showing the middle portion 9*a* of the plate spring 9 and its vicinity shown in FIG. 4 when viewed from the car longitudinal direction. As shown in FIGS. 4 to 6, the bogie frame 4 includes the receiving beam 30 fixed to the end portion 5*a* of the cross beam 5. The receiving beam 30 includes a pair of side wall portions 31 and 32, a bottom wall portion 33, and a pair of flange portions 34 and 35. The receiving beam 30 is formed by subjecting a metal plate to press working. The pair of side wall portions 31 and 32, the bottom wall portion 33, and the pair of flange portions 34 and 35 are formed integrally.

The pair of side wall portions 31 and 32 extend in the car longitudinal direction while being opposed to each other in the car width direction. The middle portion 9*a* of the plate spring 9 is arranged between the pair of side wall portions 31 and 32 and overlaps the side wall portions 31 and 32 when viewed from the car width direction. To be specific, the plate spring 9 extends in the car longitudinal direction through a space between the pair of side wall portions 31 and 32. An opening 31*a* through which part of a side surface of the middle portion 9*a* of the plate spring 9 is exposed is formed at a middle portion of the side wall portion 31 located at an outside in the car width direction out of the pair of side wall portions 31 and 32.

To be specific, when assembling the bogie, the side surface of the middle portion 9*a* of the plate spring 9 can be visually confirmed through the opening 31*a* from an outside of the bogie 1 in the car width direction. It should be noted that the opening 31*a* may be finally closed from the outside in the car width direction by a cover member (not shown) detachably attached to the side wall portion 31. Cutouts 31*b* through which the side surface of the plate spring 9 is exposed are formed at the side wall portion 31 so as to be located at both respective sides of the cross beam 5 in the car longitudinal direction. Specifically, the cutouts 31*b* are formed by reducing the heights of both car longitudinal direction end portions of the side wall portion 31 (i.e., by reducing the amounts of upward projections of both car longitudinal direction end portions of the side wall portion 31 from the bottom wall portion 33).

The bottom wall portion 33 connects lower ends of the pair of side wall portions 31 and 32 to each other and covers the plate spring 9 from below. The pair of flange portions 34 and 35 project from respective upper ends of the pair of side wall portions 31 and 32 in directions away from each other along the car width direction. In the receiving beam 30, a plate spring insertion space S surrounded by the pair of side wall portions 31 and 32 and the bottom wall portion 33 is open upward. The cross beam 5 includes a horizontal plate portion 5*b* at at least the end portion 5*a*. A depressed portion 5*c* to which the flange portion 34 is fitted is formed on a lower surface of the horizontal plate portion 5*b*. By fitting the flange portion 34 to the depressed portion 5*c* from below, the receiving beam 30 is positioned relative to the cross beam 5 in the car longitudinal direction and the car width direction. It should be noted that the positioning between the horizontal plate portion 5*b* of the cross beam 5 and the receiving beam 30 may be performed by a positioning pin inserted into the horizontal plate portion 5*b* of the cross beam 5 and the receiving beam 30. The flange portions 34 and 35 are detachably fixed to the horizontal plate portion 5*b* of the cross beam 5 by fasteners 37 (for example, bolts). The receiving beam 30 does not contact the plate spring 9, i.e., the receiving beam 30 is spaced apart from the plate spring 9.

The receiving beam 30 includes projecting portions 36 located at both respective car longitudinal direction sides of the cross beam 5 and projecting toward a lower surface of the plate spring 9. Each of gaps is formed between each of the projecting portions 36 and the lower surface of the plate spring 9. The gaps each between the plate spring 9 and the projecting portion 36 are exposed to an outside in the car width direction through the cutouts 31*b* of the receiving beam 30. To be specific, the gaps can be visually confirmed from the outside of the bogie 1 in the car width direction.

The pair of receiving seats 15 provided at each car longitudinal direction tip end of the receiving beam 30 are opposed to each other in the car width direction. Each of the pair of receiving seats 15 includes a recess portion 38 and a groove portion 21. The recess portion 38 is formed by depressing an upper end surface of the receiving seat 15 downward and is open toward both sides in the car width direction and an upper side. The recess portion 38 includes a bottom surface 38*a* and a pair of side surfaces 38*b* extending upward from both respective car longitudinal direction ends of the bottom surface 38*a*.

The groove portion 21 is formed by depressing part of the bottom surface 38*a* of the recess portion 38 downward and is open toward both sides in the car width direction and an upper side. A width of the groove portion 21 in the car longitudinal direction is smaller than a width of the recess portion 38 in the car longitudinal direction. The protruding portion 13*c* of the core rod 13 is fitted into the groove portion 21 from above. Each of a contact surface of the protruding portion 13*c* and a contact surface of the groove portion 21 which surfaces contact each other has a circular-arc shape in a side view of the bogie. With the protruding portion 13*c* fitted into the groove portion 21, the lid 16 is accommodated in the recess portion 38 so as to contact an upper surface of the protruding portion 13*c*.

The lid 16 is fixed to the receiving seat 15 from above by the fasteners 17 (see FIG. 1), such as bolts, and the protruding portion 13*c* is pressed by the lid 16 from above. Internal screw holes 39 are formed on the bottom surface 38*a* of the recess portion 38 so as to be located at both respective sides of the groove portion 21. The fasteners 17 pass through respective through holes (not shown) of the lid 16 and are fastened to the respective internal screw holes 39. With this, the core rod 13 is sandwiched by the receiving seats 15 and the lids 16.

The lid 16 includes at least surfaces opposed to the upper surface of the protruding portion 13*c*, the bottom surface 38*a* of the recess portion 38, and the side surfaces 38*b* of the recess portion 38. In the lid 16, the surface opposed to the bottom surface 38*a* of the recess portion 38 and the surface opposed to the upper surface of the protruding portion 13*c* are continuously formed on the same plane. To be specific, a flat lower surface of the lid 16 is a surface opposed to the upper surface of the protruding portion 13*c* and the bottom surface 38*a* of the recess portion 38. For example, the lid 16 has a rectangular solid shape.

According to the above-described configuration, the groove portion 21 into which the protruding portion 13*c* of the core rod 13 is fitted is open upward. Therefore, when assembling the bogie, the protruding portion 13*c* of the core rod 13 is fitted into the groove portion 21 from above, and the lid 16 covers the protruding portion 13*c* from above and is fixed to the receiving seat 15. Thus, assembling work of the axle box suspension 11 can be performed from an upper side, and this improves the work property. Further, load generated when the core rod 13 is about to come out downward from the groove portion 21 is not supported by the lids 16 but is supported from below by the receiving seats 15 provided at the bogie frame 4. Therefore, even if the fasteners 17 fixing the lid 16 fall off, the core rod 13, the axle beam 12, and the like do not fall from the bogie frame 4. Further, since it is unnecessary to additionally provide a loosening preventing part or a falling preventing part, the number of parts can be reduced. Even if the core rod 13 is about to come out from the groove portion 21 upward, the tubular portion 12*a* of the axle beam and the plate spring 9 supporting the load of the carbody contact each other, and the plate spring 9 serves as a stopper. Therefore, the axle beam 12 and the wheelset 6 can be prevented from separating from the bogie 1.

In the bogie 1 including the plate spring 9 as a primary suspension, the side wall portions 31 and 32 protecting the plate spring 9 from lateral sides and the bottom wall portion 33 protecting the plate spring 9 from a lower side are formed integrally. Therefore, the number of parts can be reduced, and assembling work performed from a lower side can be reduced.

The receiving beam 30 is integrally configured such that the plate spring insertion space S surrounded by the pair of side wall portions 31 and 32 and the bottom wall portion 33 is open upward. Therefore, when assembling the bogie, the receiving beam 30 can easily cover the plate spring 9 from below, and the groove portions 21 of the receiving seats 15 fixed to the receiving beam 30 can be easily fitted to the protruding portions 13*c* of the core rod 13.

The receiving beam 30 includes the pair of flange portions 34 and 35 projecting from the respective upper ends of the pair of side wall portions 31 and 32 toward both respective sides in the car width direction. Therefore, by fixing the flange portions 34 and 35 to the cross beam 5, the bogie frame 4 placed on the plate spring 9 from above can be easily fixed to the receiving beam 30. Thus, the assembly work property becomes excellent.

The opening 31*a* through which part of the side surface of the plate spring 9 is exposed is formed at the middle portion of the side wall portion 31 located at an outside in the car width direction out of the pair of side wall portions 31 and 32. Therefore, the middle portion 9*a* of the plate spring 9 can be visually confirmed through the opening 31*a* of the side wall portion 31. Thus, positional displacement between the plate spring 9 and the receiving beam 30 in the car longitudinal direction can be easily and directly measured. Therefore, in the configuration in which the side wall portion 31 of the bogie frame 4 covers the plate spring 9 from an outside in the car width direction, both the assembly work property and assembly accuracy of the bogie 1 can be improved.

The receiving beam 30 includes the projecting portions 36 projecting toward the lower surface of the plate spring 9, and each of the gaps is formed between each of the projecting portions 36 and the lower surface of the plate spring 9. Therefore, even if the plate spring 9 is damaged, the projecting portions 36 of the receiving beam 30 can receive the plate spring 9 from below. In addition, when the plate spring is damaged, the disappearance of the gap between the projecting portion 36 of the receiving beam 30 and the lower surface of the plate spring 9 can be visually confirmed from the outside in the car width direction through the cutout 31*b* of the side wall portion 31 of the receiving beam 30. This contributes to the facilitation of the recognition of the abnormality of the plate spring 9.

The present invention is not limited to the above-described embodiment. Modifications, additions, and eliminations may be made with respect to the configuration of the present invention. The axle box suspension 11 is the axle beam type as one example in the present embodiment but is not limited to this, and various types may be used. The shape of the lid is the rectangular solid shape but is not limited to this. For example, the groove portion 21 depressed downward from the upper end surface of the receiving seat 15 may be provided at the receiving seat 15 without providing the recess portion 38. The groove portion 21 may be depressed upward from a lower end surface of the receiving seat, and the receiving beam 30 may be connected to the receiving seat. The receiving beam connected to the receiving seat 15 may be the other type and may be, for example, formed by joining separate members to each other. Instead of using the plate spring 9 as the axle spring, a coil spring interposed between the side sill of the bogie frame and the axle box may be used. The bogie may be a bolsterless bogie instead of a bogie with a bolster.

REFERENCE SIGNS LIST

1 bogie
4 bogie frame
5 cross beam
6*a* axle
8 axle box
9 plate spring
9*a* middle portion
10 pressing member
11 axle box suspension
12 axle beam (coupler)
12*a* tubular portion
13 core rod
13*c* protruding portion
14 elastic bushing (elastic body)
15 receiving seat
16 lid
17 fastener
21 groove portion
30 receiving beam
31, 32 side wall portion
31*a* opening
31*b* cutout
33 bottom wall portion
34, 35 flange portion
36 projecting portion
S plate spring insertion space

The invention claimed is:

1. A railcar bogie comprising:

a bogie frame including a cross beam extending in a car width direction, and a receiving beam fixed to the car width direction end portion of the cross beam and extending in a car longitudinal direction;

a plurality of axle boxes accommodating a plurality of bearings supporting a plurality of axles;

a plurality of axle box suspensions coupling the plurality of axle boxes to the bogie frame; and a plate spring extending in the car longitudinal direction and supported by a pair of axle boxes arranged away from each other in the car longitudinal direction among the plurality of axle boxes, the plate spring supporting the bogie frame, wherein each of the plurality of axle box suspensions includes:

a coupler extending from the corresponding axle box in the car longitudinal direction and including a tubular portion at an end portion of the coupler, the tubular portion being open toward both sides in the car width direction;

a core rod inserted into an internal space of the tubular portion, a pair of protruding portions being provided at both respective sides of the core rod in the car width direction;

an elastic body interposed between the tubular portion and the core rod;

a pair of receiving seats provided at the receiving beam and including a pair of groove portions which are open toward the car width direction and an upper side;

a pair of lids pressing, from above, the pair of protruding portions fitted into the pair of groove portions from above;

fasteners fixing the lids to the receiving seats; wherein:

the receiving beam includes projecting portions located at both respective sides of the cross beam in the car longitudinal direction and projecting toward a lower surface of the plate spring, gaps being formed between each of the projecting portions and the lower surface of the plate spring;

the plate spring is formed in a bow shape that is convex downward, as a whole, in a side view of the bogie; and each of the projecting portions is arranged at an inner side of the receiving beam in the car longitudinal direction relative to the tubular portion.

2. The railcar bogie according to claim 1, wherein:

the bogie frame includes a pressing member provided at a lower portion of a car width direction end portion of the cross beam and pressing a middle portion of the plate spring from above; and the receiving beam includes a pair of side wall portions provided at both respective sides of the middle portion of the plate spring in the car width direction and extending in the car longitudinal direction, and a bottom wall portion connecting lower ends of the pair of side wall portions to each other and covering the plate spring from below, the pair of side wall portions and the bottom wall portion being formed integrally.

3. The railcar bogie according to claim 2, wherein:

the receiving beam further includes a pair of flange portions projecting from respective upper ends of the pair of side wall portions to both respective sides in the car width direction;

a plate spring insertion space surrounded by the pair of side wall portions and the bottom wall portion is open upward; and the pair of flange portions are fixed to the cross beam.

4. The railcar bogie according to claim 2, wherein an opening through which part of a side surface of the plate spring is exposed is formed at a middle portion of the side wall portion located at an outside in the car width direction out of the pair of side wall portions.

5. The railcar bogie according to claim 2, wherein:

cutouts through which a side surface of the plate spring is exposed are formed on at least one of the pair of side wall portions; and the gaps are exposed through the respective cutouts.

6. The railcar bogie according to claim 3, wherein an opening through which part of a side surface of the plate spring is exposed is formed at a middle portion of the side wall portion located at an outside in the car width direction out of the pair of side wall portions.

7. The railcar bogie according to claim 3, wherein:

cutouts through which a side surface of the plate spring is exposed are formed on at least one of the pair of side wall portions; and the gaps are exposed through the respective cutouts.

8. The railcar bogie according to claim 4, wherein:

cutouts through which a side surface of the plate spring is exposed are formed on at least one of the pair of side wall portions; and the gaps are exposed through the respective cutouts.

9. The railcar bogie according to claim 6, wherein:

cutouts through which a side surface of the plate spring is exposed are formed on at least one of the pair of side wall portions; and the gaps are exposed through the respective cutouts.

10. A railcar bogie comprising:

a bogie frame;

a plurality of axle boxes accommodating a plurality of bearings supporting a plurality of axles; and a plurality of axle box suspensions coupling the plurality of axle boxes to the bogie frame, wherein each of the plurality of axle box suspensions includes:

a coupler extending from the corresponding axle box in a car longitudinal direction and including a tubular portion at an end portion of the coupler, the tubular portion being open toward both sides in a car width direction;

a core rod inserted into an internal space of the tubular portion, a pair of protruding portions being provided at both respective sides of the core rod in the car width direction;

an elastic body interposed between the tubular portion and the core rod;

a pair of receiving seats provided at the bogie frame and including a pair of groove portions which are open toward the car width direction and an upper side;

a pair of lids pressing, from above, the pair of protruding portions fitted into the pair of groove portions from above; and fasteners fixing the lids to the receiving seats; and a plate spring extending in the car longitudinal direction and supported by a pair of axle boxes arranged away from each other in the car longitudinal direction among the plurality of axle boxes, the plate spring supporting the bogie frame, wherein:

the bogie frame includes a cross beam extending in the car width direction, a pressing member provided at a lower portion of a car width direction end portion of the cross beam and pressing a middle portion of the plate spring from above, and a receiving beam fixed to the car width direction end portion of the cross beam and extending in the car longitudinal direction, the receiving seats being fixed to the receiving beam; and the receiving beam includes a pair of side wall portions provided at both respective sides of the middle portion of the plate spring in the car width direction and extending in the car longitudinal direction, and a bottom wall portion connecting lower ends of the pair of side wall portions to each other and covering the plate spring from below, the pair of side wall portions and the bottom wall portion being formed integrally, wherein:

the receiving beam further includes a pair of flange portions projecting from respective upper ends of the pair of side wall portions to both respective sides in the car width direction;

a plate spring insertion space surrounded by the pair of side wall portions and the bottom wall portion is open upward; and the pair of flange portions are fixed to the cross beam.

11. A railcar bogie comprising:

a bogie frame;

a plurality of axle boxes accommodating a plurality of bearings supporting a plurality of axles; and a plurality of axle box suspensions coupling the plurality of axle boxes to the bogie frame, wherein each of the plurality of axle box suspensions includes:

a coupler extending from the corresponding axle box in a car longitudinal direction and including a tubular portion at an end portion of the coupler, the tubular portion being open toward both sides in a car width direction;

a core rod inserted into an internal space of the tubular portion, a pair of protruding portions being provided at both respective sides of the core rod in the car width direction;

an elastic body interposed between the tubular portion and the core rod;

a pair of receiving seats provided at the bogie frame and including a pair of groove portions which are open toward the car width direction and an upper side;

a pair of lids pressing, from above, the pair of protruding portions fitted into the pair of groove portions from above; and fasteners fixing the lids to the receiving seats; and a plate spring extending in the car longitudinal direction and supported by a pair of axle boxes arranged away from each other in the car longitudinal direction among the plurality of axle boxes, the plate spring supporting the bogie frame, wherein:

the bogie frame includes a cross beam extending in the car width direction, a pressing member provided at a lower portion of a car width direction end portion of the cross beam and pressing a middle portion of the plate spring from above, and a receiving beam fixed to the car width direction end portion of the cross beam and extending in the car longitudinal direction, the receiving seats being fixed to the receiving beam; and the receiving beam includes a pair of side wall portions provided at both respective sides of the middle portion of the plate spring in the car width direction and extending in the car longitudinal direction, and a bottom wall portion connecting lower ends of the pair of side wall portions to each other and covering the plate spring from below, the pair of side wall portions and the bottom wall portion being formed integrally, wherein:

cutouts through which a side surface of the plate spring is exposed are formed on at least one of the pair of side wall portions;

the receiving beam further includes projecting portions located at both respective sides of the cross beam in the car longitudinal direction and projecting toward a lower surface of the plate spring, gaps being formed between each of the projecting portions and the lower surface of the plate spring;

the gaps are exposed through the respective cutouts;

the plate spring is formed in a bow shape that is convex downward, as a whole, in a side view of the bogie; and each of the projecting portions is arranged at an inner side of the receiving beam in the car longitudinal direction relative to the tubular portion.

* * * * *